US010533511B2

(12) United States Patent
Hauser et al.

(10) Patent No.: US 10,533,511 B2
(45) Date of Patent: Jan. 14, 2020

(54) CONTROLLING A FUEL INJECTION SOLENOID VALVE

(71) Applicant: CONTINENTAL AUTOMOTIVE GMBH, Hannover (DE)

(72) Inventors: Christian Hauser, Lappersdorf (DE); Gerd Rösel, Regensburg (DE); Markus Stutika, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 15/782,516

(22) Filed: Oct. 12, 2017

(65) Prior Publication Data

US 2018/0030912 A1 Feb. 1, 2018

Related U.S. Application Data

(63) Continuation of application No. PCT/EP2016/058089, filed on Apr. 13, 2016.

(30) Foreign Application Priority Data

Apr. 15, 2015 (DE) ..... 10 2015 206 729

(51) Int. Cl.
*F02D 41/20* (2006.01)
*F02M 51/06* (2006.01)
(Continued)

(52) U.S. Cl.
CPC ..... *F02D 41/20* (2013.01); *F02M 51/061* (2013.01); *F02M 61/161* (2013.01);
(Continued)

(58) Field of Classification Search
CPC .... F02D 41/20; F02M 51/061; F02M 61/161; F02M 63/0007; F02M 63/0015; F02M 63/007
See application file for complete search history.

(56) References Cited

U.S. PATENT DOCUMENTS 5,673,165 A 9/1997 Kuhn et al.
5,691,680 A 11/1997 Schrey et al.
(Continued)

FOREIGN PATENT DOCUMENTS

DE 102004021366 A1 11/2005
DE 102005042110 A1 3/2007
DE 102010064048 A1 6/2012

OTHER PUBLICATIONS

International Search Report and Written Opinion dated Jul. 1, 2016 from corresponding International Patent Application No. PCT/EP2016/058089.
(Continued)

*Primary Examiner* — Hai H Huynh
*Assistant Examiner* — Gonzalo Laguarda

(57) ABSTRACT

A device and a method are provided for controlling a magnetic valve which has a coil and an armature which is displaceable by magnetic force, by means of which armature a closure element is displaceable for the purposes of injecting fuel into a combustion chamber, the method includes the steps of: energizing the coil with a voltage in accordance with a first voltage profile in order to generate a first electrical current through the coil; determining a first profile as a function of a first magnetic flux and the first current; identifying, in the first profile, a first characteristic of at least one first start of displacement at which the armature begins to displace the closure element, generating a second voltage profile and energizing the coil in accordance with the second voltage profile, such that, in a second profile, as a function of a second magnetic flux and a second current, a second characteristic of a second start of displacement is more similar to a reference characteristic than the first characteristic.

18 Claims, 6 Drawing Sheets

(51) Int. Cl.
*F02M 61/16* (2006.01)
*F02M 63/00* (2006.01)

(52) U.S. Cl.
CPC ..... *F02M 63/0007* (2013.01); *F02M 63/007* (2013.01); *F02M 63/0015* (2013.01); *F02D 2041/2037* (2013.01); *F02D 2041/2051* (2013.01); *F02D 2041/2055* (2013.01); *F02D 2041/2058* (2013.01)

(56) References Cited

U.S. PATENT DOCUMENTS 5,742,467 A 4/1998 Schmitz
5,991,143 A * 11/1999 Wright ..... B82Y 15/00 361/167
6,128,175 A * 10/2000 Wright ..... F02D 41/20 361/154
6,249,418 B1 6/2001 Bergstrom
7,559,311 B2 * 7/2009 Tanaka ..... F02D 41/20 123/458
9,194,345 B2 * 11/2015 Imai ..... F02M 51/061
9,671,033 B2 * 6/2017 Tanabe ..... F02D 41/3845
9,863,355 B2 * 1/2018 Gopalakrishnan ..... F02D 41/20
2011/0288748 A1 11/2011 Richter et al.

OTHER PUBLICATIONS

German Office Action dated Jan. 13, 2016 for corresponding German Patent Application No. 10 2015 206 729.7.
Korean Office Action dated Aug. 16, 2018 from corresponding Korean Patent Application 10-2017-7029618.
Korean Notice of Allowance dated Feb. 15, 2019 for the corresponding Korean Patent Application 10-2017-7029618.
International Preliminary Report on Patentability, dated Oct. 17, 2017, for corresponding PCT patent application PCT/EP2016/058090.

* cited by examiner

CONTROLLING A FUEL INJECTION SOLENOID VALVE

CROSS-REFERENCE TO RELATED APPLICATIONS

This application claims the benefit of PCT Application PCT/EP2016/058089, filed Apr. 13, 2016, which claims priority to German Patent Application 10 2015 206 729.7, filed Apr. 15, 2015. The disclosures of the above applications are incorporated herein by reference.

FIELD OF THE INVENTION

The present invention relates to a method and a device for controlling a magnetic valve for injecting fuel into a combustion chamber. In particular, the present invention relates to an engine control unit which is designed to control a fuel injection magnetic valve.

BACKGROUND OF THE INVENTION

A magnetic valve or a solenoid injector may be used for injecting fuel into a combustion chamber, for example into a cylinder. A solenoid injector of this type (also referred to as coil-type injector) has a coil which generates a magnetic field when current flows through the coil, whereby a magnetic force is exerted on an armature such that the armature is displaced in order to effect an opening and closing of a nozzle needle or of a closure element for the purposes of opening and closing the magnetic valve. If the magnetic valve or the solenoid injector exhibits a so-called idle stroke between armature and nozzle needle or between armature and closure element, then a displacement of the armature leads to a displacement also of the closure element or of the nozzle needle not immediately but rather only after the armature has been displaced by the extent of the idle stroke.

When a voltage is applied to the coil of the magnetic valve, electromagnetic forces cause the armature to be moved in the direction of a pole piece. By means of a mechanical coupling (for example mechanical contact), after the idle stroke has been overcome, the nozzle needle or the closure element likewise moves (during the working stroke or needle stroke) and, in the case of corresponding displacement, opens up injection holes for the feed of fuel into the combustion chamber. If current continues to flow through the coil, the armature and nozzle needle or closure element move further until the armature arrives at and abuts against the pole piece. The distance between the abutment of the armature against a driver of the closure element or of the nozzle needle and the abutment of the armature against the pole piece is also referred to as needle stroke or working stroke. To close the valve, the excitation voltage applied to the coil is deactivated, and the coil is short-circuited, such that the magnetic force is dissipated. The short-circuiting of the coil results in a polarity reversal of the voltage owing to the dissipation of the magnetic field stored in the coil. The level of the voltage is limited by means of a diode. Owing to a restoring force which is provided for example by a spring, the nozzle needle or closure element including armature are moved into the closed position. Here, the idle stroke and the needle stroke are passed through in the reverse sequence.

The time of the start of the needle movement during the opening of the magnetic valve may be dependent on the magnitude of the idle stroke. The time of the abutment of the needle or of the armature against the pole piece is dependent on the magnitude of the needle stroke or working stroke. The injector-specific time variations of the start of the needle movement (opening) and of the end of the needle movement (closing) may, in the case of identical electrical actuation, result in different injection quantities.

After the armature has overcome the idle stroke for the purposes of opening the magnetic valve (if an idle stroke is present in the magnetic valve under consideration), the armature abuts against the pole piece, which prevents a further movement or displacement of the armature in the direction for opening the magnetic valve. Upon the abutment, the armature may be elastically repelled, and after the armature has been repelled by a certain displacement stroke, it may abut against the pole piece again. In this way, the armature may perform a bouncing movement, in the case of which it is repelled at least once by the pole piece, is accelerated in a direction for the closure of the magnetic valve, and is then in turn accelerated and displaced in a direction for the opening of the magnetic valve owing to the magnetic force that is still acting. The bouncing process may in this case comprise one or more states of abutment of the armature against the pole piece.

The bouncing or the bouncing movement may individually differ for different injectors or magnetic valves, for example with regard to different damping actions owing to mechanical deviations (hydraulic gap), different materials, different elastic characteristics, different masses of the moving parts, in particular of the armature etc. Thus, in different magnetic valves or injectors, different quantity characteristic curves may arise when the injector is closed again during the bouncing process. A closing process may in this case be dependent in particular on whether the armature moves for example in the direction of opening of the valve or in the direction of closing of the valve at the start of an intended closing process.

Furthermore, in the bouncing region, or during the bouncing movement, the injector actuation (in particular the actuation of the magnetic valve for the opening of the magnetic valve) may also be difficult or inaccurate, because a unique dependency of actuation duration (for example duration of the boost voltage and/or duration of a holding voltage interval) and the injection quantity will imperatively not always be present. For example, the injection quantity may decrease despite increasing actuation duration (in particular increasing duration of the boost voltage and/or increasing duration of the holding voltage during a voltage profile).

Thus, in conventional injection systems which use a magnetic valve, inaccuracies may arise with regard to the desired injection quantity of the fuel and also with regard to the desired characteristic of the injection of the fuel with respect to time.

In conventional methods, injection times which exhibit pronounced bouncing behavior in the actuation of the magnetic valve are avoided. It is thus possible for the regions with the adverse effects of the bouncing behavior in the quantity characteristic map to be excluded. The actuation is thus however subject to significant restrictions, which may have adverse effects on the operation of the internal combustion engine.

SUMMARY OF THE INVENTION

It is therefore an object of the present invention to provide a method and a device, in particular an engine control unit, which makes it possible to improve an injection process, in particular with regard to an injection quantity and a profile of the injection with respect to time, in relation to the prior art. In particular, it is an object of the present invention to reduce inaccuracies or unreliabilities owing to bouncing in a magnetic valve.

The object is achieved by means of the subjects of the independent claims. The dependent claims specify particular embodiments of the present invention.

According to a first aspect of the present invention, a method is provided for controlling a magnetic valve which has a coil and an armature which is displaceable by magnetic force, by means of which armature a closure element is displaceable for the purposes of injecting fuel into a combustion chamber. Here, the method comprises energizing the coil with a voltage in accordance with a first voltage profile in order to generate a first electrical current through the coil, determining a first profile as a function of a first magnetic flux and the first current, identifying, in the first profile, a first characteristic of at least one first start of displacement at which the armature begins to displace the closure element, generating a second voltage profile and energizing the coil in accordance with the second voltage profile, such that, in a second profile, as a function of a second magnetic flux and a second current, a second characteristic of a second start of displacement is more similar to a reference characteristic than the first characteristic.

The method may be carried out by a special control unit in a workshop or in a production factory or in particular also by an engine control unit which is installed and used in a vehicle for normal driving operation. The closure element may be formed for example as a needle, in particular nozzle needle, which on one end bears a closure ball which, in a closed state of the magnetic valve, bears against a conical seat and, in an open state, is displaced out of the seat, such that the fuel may pass through an opening in the seat into the combustion chamber.

The first voltage profile and the second voltage profile may in this case for example each comprise a boost phase in which the voltage amounts to a relatively high value, for example between 60 V and 70 V, in particular approximately 65 V. The voltage profile within the boost phase may for example substantially have a rectangular signal or else a sawtooth signal. Both in the first voltage profile and in the second voltage profile, the boost phase may be followed by a holding phase, in which the voltage is significantly lower than in the boost phase and for example lies between 6 V and 14 V. The holding phase may be longer in terms of time than (for example between four times as long and 10 times as long as) the boost phase. The holding phase may for example have a duration of 1 ms to 2 ms. The holding phase may in turn be divided into multiple phases for which different mean current levels are predefined. When the current levels are reached, the voltage is activated or deactivated respectively, such that the current oscillates around the current level. In the closing phase, the injector is separated from the voltage supply and is short-circuited.

Here, the first voltage profile and the second voltage profile may differ with regard to the level of the boost phase, with regard to the duration of the boost phase, with regard to the profile of the boost phase (for example the voltage profile during the boost phase, for example an alternating rectangular signal, a sawtooth signal or the like). Furthermore, the first and the second voltage profile may differ with regard to a voltage during the holding phase and also with regard to a duration of the holding phase.

The application of the voltage in accordance with the first voltage profile or in accordance with the second voltage profile generates a corresponding current profile in the coil. The corresponding current profile leads to a profile of a magnetic field which, in turn, aside from the geometrical influences, influences the relative positioning of armature, closure element, driver and pole piece.

The first profile as a function of a first magnetic flux and the first current may be directly dependent on the first magnetic flux and the first current, or on variables which are derived from the first magnetic flux and the first current, for example functions of the first magnetic flux and of the first current respectively. The first profile may then be analyzed or evaluated in order to characterize the first start of displacement. The first profile may, as a function of the first magnetic flux and the first current, comprise for example a section in which the armature already bears against and makes contact with the closure element, or a driver connected to the closure element, without displacing the driver or the closure element. Thus, in this section, no movement is observed, because a rising magnetic force must firstly be built up in order to at least equal a force which acts oppositely owing to the pressure of the fuel. Upon the start of displacement, exact force equilibrium is attained, in the case of which the force generated owing to the magnetic flux is equal and opposite to the force acting owing to the fuel pressure.

Characterizing at least this first start of displacement may allow conclusions to be drawn regarding the pressure of the fuel. Furthermore, from this, an expected bouncing behavior may be predicted, and the second voltage profile may be determined such that the expected bouncing is reduced. What may be indicative of the fact that the bouncing behavior has been reduced or a bouncing amplitude has been reduced is a second characteristic of the second start of displacement, which, for the reduction of the bouncing, is more similar to a reference characteristic than the first characteristic.

For the determination of the respective characteristics, use may be made not only of a respective start of displacement but also of one or more sections, or the entirety, of the respective profile which is determined as a function of the respective magnetic flux and the respective current, represented in particular by a curve in a coordinate system which comprises the current through the coil and the magnetic flux.

Control of the magnetic valve may thus be performed even before the actual opening of the magnetic valve, in order to thus intervene in the control at as early a time as possible in order to be able to inject a defined fuel quantity into the combustion chamber upon opening.

In the method according to the invention, an improvement of the bouncing behavior of magnetic injectors may be achieved by means of evaluation of the magnetic flux and current and/or voltage adaptation.

The first profile and the second profile may be representable or represented by a first curve and a second curve respectively in a coordinate system in which the current is plotted along one axis (for example the X axis) and the magnetic flux is plotted along another axis (for example the Y axis). Here, the magnetic flux may for example be calculated mathematically by means of the measured voltage and the measured current taking into consideration the ohmic resistance of the coil. Thus, the first profile and the second profile may be determined in a simple manner, and in particular also visualized and thus easily evaluated.

The first characteristic and the second characteristic may for example comprise a gradient ($d\psi/di$) and/or a position (that is to say position of current or magnitude of current and magnitude of the magnetic flux) on the respective curve, in particular at least at the respective start of displacement, furthermore in particular along at least one section of an opening movement of the closure element between the start of displacement and a contact state in which the armature abuts against a pole piece in order to end the opening movement (for the first time). Here, the reference characteristic may comprise at least one reference gradient and/or one reference position. The respective characteristics are thus determined in a simple manner for example by means of mathematical curve sketching. The respective contact state may in this case represent the end of the opening movement. If bouncing occurs or would be expected to occur during the actuation in accordance with the first voltage profile, then the first contact state is regarded as the first abutment of the armature against the pole piece. It may be advantageous for bouncing that is expected to occur to be determined solely on the basis of the characteristic at the start of displacement, in order that a control intervention may be performed even before the opening of the magnetic valve in order to configure the second voltage profile such that the bouncing that is expected to occur is reduced.

The respective start of displacement may be identified as a point or a region of the ψ-i curve (magnetic flux plotted versus current) at which a gradient of the respective curve changes. Other possibilities for the identification of the respective start of displacement are possible.

The respective contact state may be identifiable as a point or region (on the ψ-i curve) at which a gradient of the respective curve changes. Other methods for the identification of the contact state are possible.

It is thus possible for both the start of displacement and the contact state to be reliably located.

The energizing of the coil in accordance with the second voltage profile may be performed at a time before the first contact state, that is to say even before any bouncing. In particular, the second voltage profile may have a different, in particular lengthened, shortened or interrupted, duration of a boost phase in relation to the first voltage profile. The duration of the boost phase may be adapted such that bouncing that would occur if the voltage in accordance with the first voltage profile were maintained is reduced. Here, it is for example possible for the first profile between the start of displacement and the contact state to be evaluated in order to then define the second voltage profile. For example, the start of displacement, in particular the first start of displacement, may be identified, and predefined actuation/pilot control may be performed proceeding from or upon the first start of displacement (for example current value at the start of displacement with the addition of a defined current difference or with the addition of a lengthening of the boost phase). Other modifications or adaptations of the second voltage profile are possible.

The energization of the coil in accordance with the second voltage profile may be performed at a time after the first contact state, in particular after the first abutment but still before any bouncing movement. Here, in particular, the second voltage profile may have a different, in particular lengthened or shortened, duration of a boost phase in relation to the first voltage profile, or it may have an interrupted boost phase which is characterized by multiple partial boost phases, which are in each case interrupted by a phase of reduced voltage.

For example, the first contact point (in particular the first abutment of the armature against the pole piece) may be identified while the first voltage profile is applied to the coil. After identification of the first contact point, it is possible for predefined actuation/pilot control to be performed at the first contact point (for example current value at the first contact point with the addition of a defined current difference or with the addition of a lengthening of the boost phase or interruption of the boost phase with subsequent continuation).

Combinations of actuations after identification of the start of displacement, between the start of displacement and the first contact point and an entire section between the start of displacement and the first contact point may be taken into consideration for the definition of the second voltage profile. Thus, bouncing such as could arise in the case of application of the voltage in accordance with the first voltage profile is reduced.

Furthermore, the respective characteristic may furthermore be determined as a function of at least one section of the respective curve beyond the contact state (in particular beyond a respective first abutment of the armature against the pole piece), wherein the second voltage profile is configured such that the section has fewer alternating gradients. Thus, it is possible at any rate for a bouncing process to be at least shortened by virtue of a control intervention being performed after the start of the bouncing process.

For the locating or definition of the second voltage profile, it is possible in particular for a simulation or testing of the operation of the magnetic valve to be performed. In particular, training data may be recorded on the basis of different voltage profiles, and the voltage profiles or the test voltage profiles may be characterized with regard to the occurrence of bouncing. In particular, a dependency between a characteristic of certain sections of the curve and bouncing (which occurs later) may be determined from an analysis of sections of the various curves thus obtained. In particular, it is thus possible for a prediction of any bouncing to be made on the basis of an analysis of certain sections of the curve before the bouncing.

Furthermore, the method may comprise providing at least one reference data set, wherein the reference data set may have a reference curve of current and magnetic flux in the case of an adequately low level of bouncing of the armature on the pole piece. The second voltage profile may then be configured such that a curve obtained on the basis of the second voltage profile lies relatively similarly or close to the reference curve.

The voltage in accordance with the first voltage profile self-evidently need not be applied for the entire time interval defined by the first voltage profile. Rather, the application of the voltage in accordance with the first voltage profile may be interrupted at the respective point (for example upon the first start of displacement, between the first start of displacement and the first contact state) or even prior to that, and the voltage may be continued in accordance with the second voltage profile starting at the point at which the first voltage profile was interrupted. In other embodiments, the first voltage profile is run through in its entirety, and a voltage in accordance with the second voltage profile is applied to the coil for a further opening process of the valve.

It is to be understood that features that have been discussed, described, provided or used individually or in any combination in conjunction with a method for controlling a magnetic valve are likewise applicable individually or in any combination to a device, in particular engine control unit, for controlling a magnetic valve as per embodiments of the present invention, and vice versa.

According to a second aspect of the present invention, a device, in particular engine control unit, is provided for controlling a magnetic valve which has a coil and an armature which is displaceable by magnetic force, by means of which armature a closure element is displaceable for the purposes of injecting fuel into a combustion chamber. Here, the device has a driver for energizing the coil with a voltage in accordance with a first voltage profile in order to generate a first electrical current through the coil, and a determination module which is designed to determine a first profile as a function of a first magnetic flux and the first current and to identify, in the first profile, a first characteristic of at least one first start of displacement at which the armature begins to displace the closure element, wherein the driver is furthermore designed to generate a second voltage profile and to energize the coil in accordance with the second voltage profile, such that, in a second profile, as a function of a second magnetic flux and a second current, a second characteristic of a second start of displacement is more similar to a reference characteristic than the first characteristic.

The determination module may for example comprise an arithmetic/logic unit, an electronic memory and a communication connection to the driver. The device may be designed to carry out a method according to embodiments of the present invention. Here, the method may be carried out during normal driving operation. Here, the magnetic flux may pass through the armature and, in part, through the pole piece, which is fixed relative to the coil, and furthermore through parts of the closure element or at least parts of a driver which is fixedly connected to the closure element.

According to embodiments of the present invention, a method is proposed in which, by means of the ψ-i curve, the injector movement (in particular movement of the closure element) is identified, and the actuation is modified (from the first voltage profile to the second voltage profile) such that the bouncing behavior is reduced. Here, for example in the ψ-i curve, the needle movement, for example state I (start of displacement) and/or state II (contact state), may be determined, and the associated actuation may be optimized with regard to a reduction of bouncing, for example through modification of the peak current level (for example boost voltage level) or interruption of the actuation voltage (for example in the boost phase). For example, the entire needle movement between the state I (start of displacement) and the contact state or state II may be identified, and the actuation may be adapted such that the gradients dψ/di during the movement are identical for different injectors (adaptation to setpoint value or reference curve). If the state I (start of displacement) is incorporated into the identification, then the needle movement may, even after the start of the movement, be moved onto a bouncing-minimized path through suitable actuation, that is to say a regulating intervention may be performed already before the bouncing process.

To be able to carry out the measurement of the ψ-i curves even in the case of a standard actuation of the magnetic valve, a construction of an injector (or magnetic valve, in particular armature) is proposed in which no eddy currents, or reduced eddy currents, occur. In the case of such an injector with reduced eddy currents, the curve profiles during the stroke movements are more pronounced, such that an identification of the state I (start of displacement) and of the state II (contact state) is simplified. Here, an adaptation of the materials and/or of the geometries are performed. In particular, use may be made of a slotted armature or an armature built up from ferromagnetic layers which are electrically insulated with respect to one another. Embodiments of the present invention may determine the abutment of the armature against the pole piece and perform an associated modification of the actuation profile in order to reduce/avoid bouncing processes. It is advantageous for an injector to be used which exhibits no or low eddy currents, in order that the ψ-i curves may be determined during standard actuation, that is to say in particular during normal driving operation.

Embodiments of the present invention offer injector-specific actuation for the avoidance of bouncing processes and associated deficiencies in the quantity characteristic curves of the fuel. Thus, an equalization of quantity characteristic curve rail injectors is made possible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention will now be discussed with reference to the appended drawings. The invention is not restricted to the illustrated or described embodiments.

DETAILED DESCRIPTION OF THE PREFERRED EMBODIMENTS

The following description of the preferred embodiment(s) is merely exemplary in nature and is in no way intended to limit the invention, its application, or uses.

Figure 1:
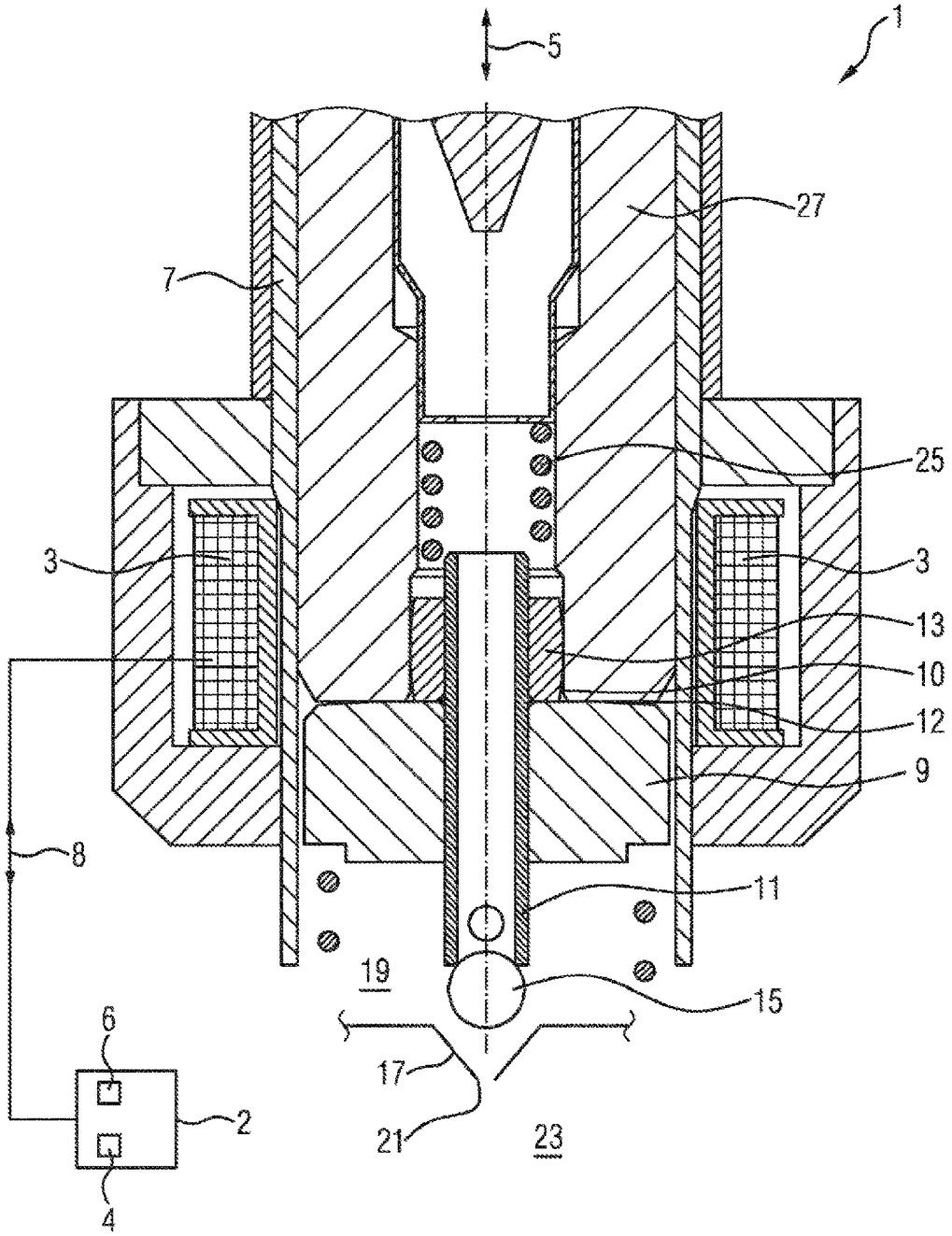
FIG. 1 illustrates, in a schematic sectional illustration, a magnetic valve which is controlled in accordance with a method according to embodiments of the present invention.

The magnetic valve 1 illustrated in a schematic sectional illustration in FIG. 1 has a coil 3 to which a voltage may be applied such that a current flow through the coil 3 occurs for the purposes of building up a magnetic field. Here, the magnetic field points substantially in a longitudinal direction 5 of a guide cylinder 7. The magnetic field acts on a ferromagnetic armature 9 which is displaceable within the guide cylinder 7. By means of displacement of the armature 9, a nozzle needle 11 or a closure element of the magnetic valve 1 may be displaced in the longitudinal direction 5, in particular as a result of contact of the armature 9 with a ring-shaped driver 13 which is fixedly connected to the closure element 11.

In the open state illustrated in FIG. 1, a closure ball 15 has been retracted out of a conical seat 17, such that fuel 19 may pass through an opening 21 in the seat into a combustion chamber 23 for the purposes of combustion. In the fully open state, the armature 9 bears against a pole piece 27, and is displaced no further upward.

In a closed state of the magnetic valve 1 which is not illustrated in FIG. 1, the armature 9 is, in the absence of a current flow through the coil 3, displaced downward by a restoring spring 25, such that the driver 13 together with the closure element 11 is also displaced downward such that the closure ball 15 bears sealingly against the conical seat 17, such that fuel 19 cannot pass into the combustion chamber 23. In this downwardly displaced state of the armature 9, the driver 13, and likewise the armature 9, has moved through at least a working stroke 12 (during which the armature 9 and the driver 13 are in contact), and optionally also an additional idle stroke 10, in which a gap exists between the armature 9 and the driver 13.

FIG. 1 also shows a device 2 for controlling the magnetic valve 1 according to an embodiment of the present invention. For this purpose, the device 2 has a driver 4 which is designed to, via a measurement and control line 8, energize the coil 3 with a voltage in accordance with various voltage profiles in order to generate a respective electrical current through the coil 3. For this purpose, the device 2 has a determination module 6 for determining profiles or curves as a function of a respective magnetic flux and a current flowing through the coil 3, for example the ψ-i curves, which are illustrated by way of example in FIGS. 2, 3 and 5. Furthermore, the determination module 6 is designed to identify, in the first profile, a first characteristic of at least a first start of displacement at which the armature begins to displace the closure element. The determination module 6 is furthermore designed to, together with the driver 4, modify the original or first voltage profile, and/or determine a second voltage profile, such that a characteristic of the respective start of displacement is more similar to a reference characteristic than the original or first characteristic.

In particular, the device 2 is designed to carry out a method for controlling a magnetic valve according to an embodiment of the present invention.

At the end of the opening process, the armature 9 bounces when it abuts against the pole piece 27. As a result, the armature may be elastically repelled, and the abutment and repulsion may occur repeatedly, such that the armature may perform a bouncing movement. The bouncing movement leads to uncertainties and inaccuracies in a quantity of the fuel 19 injected into the combustion chamber 23.

Embodiments of the present invention are aimed at reducing the bouncing through the performance of control interventions into a voltage profile or into a voltage progression in accordance with which the coil 3 is actuated. Here, a measurement and analysis of the interlinked magnetic flux L are performed. For this purpose, the interlinked magnetic flux L may be calculated from the current flowing through the coil 3, the voltage applied to the coil 3, and the ohmic resistance of the coil 3. The measured voltage u(t) is composed of an ohmic component (i(t)*R) and an inductive component ($u_{int}$(t)). The inductive voltage is in this case calculated from the derivative with respect to time of the interlinked magnetic flux, wherein L is dependent on the change in current i(t) and the air gap x(t).

$$u(t) = i(t)R + u_{ind} = i(t)R + \frac{d\Psi(i, x)}{dt} = i(t)R + \left(\frac{d\Psi(i, x)}{di}\frac{di}{dt} + \frac{d\Psi(i, x)}{dt}\frac{dx}{dt}\right)$$

In the case of slow actuation, the "magnetic" component of the induction as a result of change in current is small.

$$u_{ind1} = \frac{d\Psi(i, x)}{di}\frac{di}{dt}$$

The "mechanical" part of the induction as a result of the armature movement then describes the strokes (idle stroke and/or working stroke) of the magnetic valve.

$$u_{ind2} = \frac{d\Psi(i, x)}{dx}\frac{dx}{dt}$$

Through rearrangement and integration, the interlinked mechanical flux may be calculated as follows:

$$\Psi = \int (u(t) - i(t)R)dt$$

Figure 2:
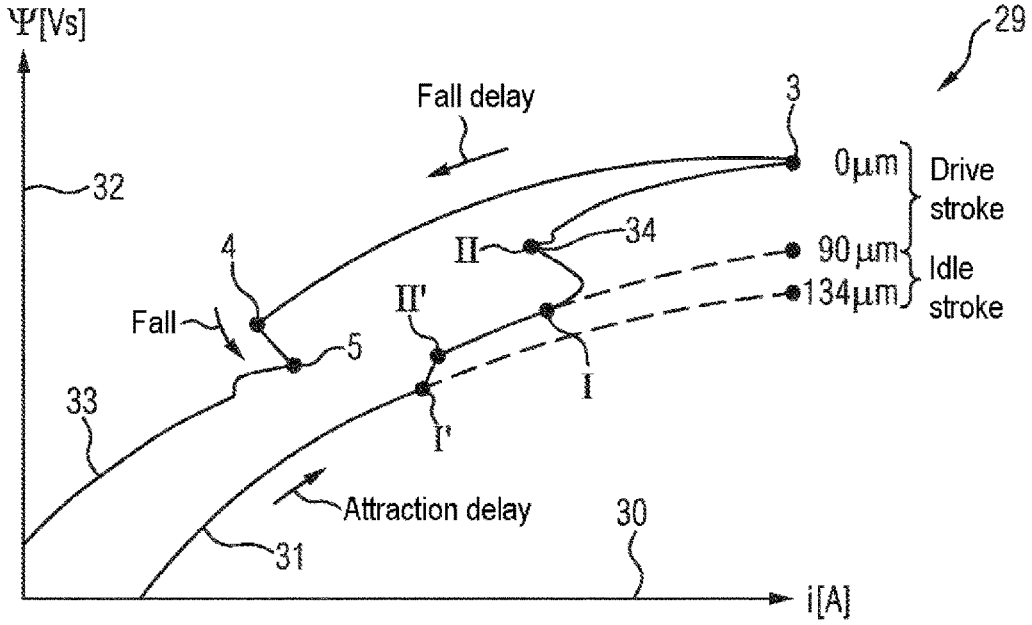
FIG. 2 illustrates graphs of reference data and state trajectories and measurement data of a magnetic valve to be controlled according to embodiments of the present invention.

FIG. 2 illustrates a graph 29 with a state trajectory 31 during an attraction (that is to say during an opening process), and a trajectory 33 during a fall (that is to say during a closing process), of the magnetic valve 1 (here for the case with idle stroke). Here, the current i flowing through the coil 3 is plotted on an abscissa 30, and the magnetic flux L calculated in accordance with the above equation is plotted on the ordinate 32. The trajectory 31 may be determined for example during a method for controlling the magnetic valve, for example by measurement of current and voltage and calculation of the magnetic flux as discussed above. From a comparison with reference data or reference trajectories not illustrated in FIG. 2, a suitable voltage profile may be determined in order to prevent bouncing. The points I', II', I, II in FIG. 2 denote characteristic states during the opening process. Here, the idle stroke from 134 μm to 90 μm, that is to say the attraction of the armature 9 during the idle stroke, takes place between the points I' and II'. The working stroke from 90 μm to 0 μm, that is to say the attraction of the armature 9 during the working stroke, takes place between the points I (start of displacement) and II (contact state). In the region II'-I, the armature bears against the driver 13.

In embodiments of the present invention, for a magnetic valve without idle stroke (FIG. 3 below) or with idle stroke (FIG. 2), the region of the trajectory 31 at the point I and/or up to the point II is evaluated. Here, in the region I'-II', a gradient of the trajectory 31 changes in relation to the sections situated before and after the region. Furthermore, in the section between points I and II, the gradient changes from a positive value to a negative value.

In FIG. 2, for example for a magnetic valve with idle stroke in a region 34 after the second state II at which the armature 9 abuts against the pole piece 27 for the first time, an undulating line may be seen which indicates the bouncing. In embodiments of the present invention, different voltages (for example in accordance with the voltage profiles described below with reference to FIG. 6) are applied to a given magnetic valve, and it is possible in each case for the ψ-I curves to be determined and evaluated. Voltage profiles which do not exhibit bouncing, that is to say in particular do not exhibit undulating lines in the region 34, may be characterized as advantageous, and may be used for the actual actuation of the magnetic valve. Other voltage profiles which give rise to sinuous lines or undulating lines or disturbances in the region 34 may be excluded from serving as actuation voltage profiles for the magnetic valve 1. From a set of training data, it is possible for predictions to be made on the basis of a determined voltage profile (for example boost voltage level, boost voltage duration, holding voltage level, holding voltage duration), whereby any occurring bouncing could be predicted.

Figure 3:
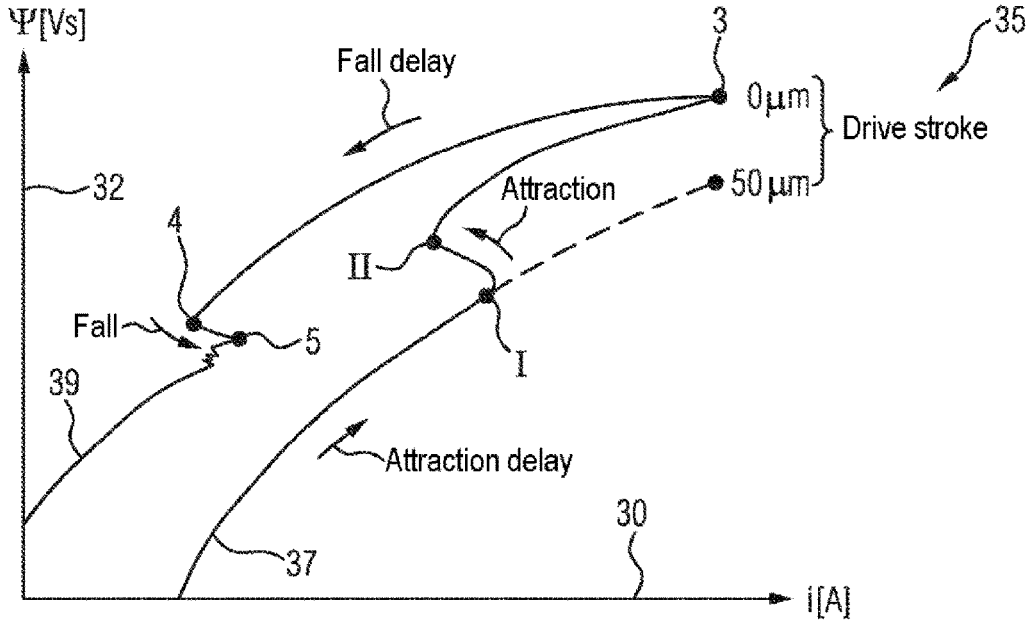
FIG. 3 illustrates graphs of reference data and state trajectories and measurement data of a magnetic valve to be controlled according to embodiments of the present invention.

FIG. 3 illustrates a graph 35 which illustrates trajectories 37 and 39 during an attraction and a fall of the armature 9 of the magnetic valve 1, in the case in which the magnetic valve 1 does not exhibit an idle stroke. Since the idle stroke is absent in the trajectory 37 illustrated in FIG. 3, the characteristic points I' and II' illustrated in FIG. 2 are absent. The working stroke from 50 μm to 0 μm takes place between the points I and II. Here, the trajectory 37 has a bend at the point I, at which bend a positive gradient changes to a negative gradient.

Figure 4:
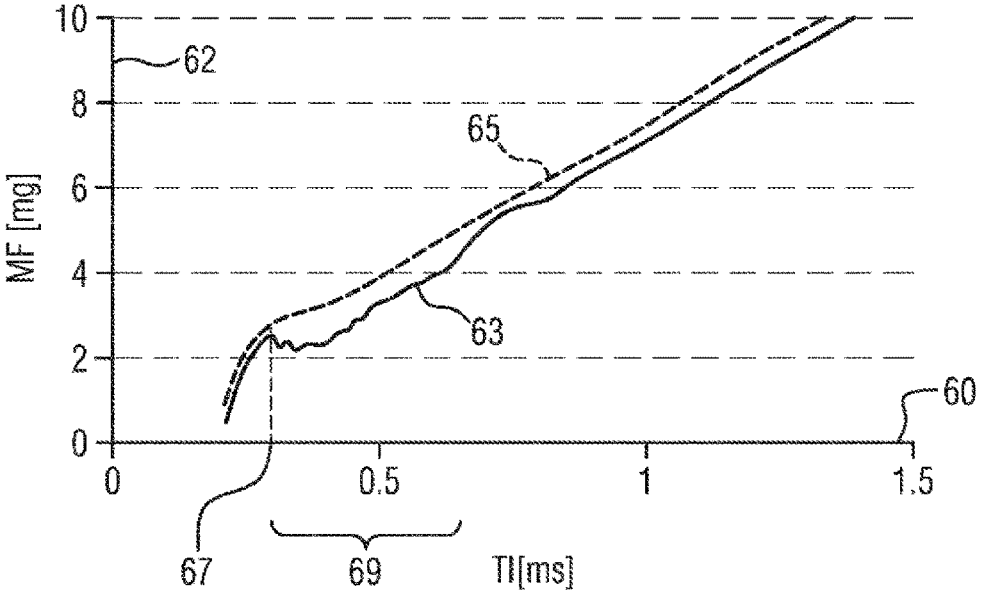
FIG. 4 illustrates quantity characteristic curves for injectors with and without bouncing, in accordance with the prior art.

FIG. 4 illustrates a graph in which an injection time TI in milliseconds is plotted on an abscissa 60 and the injection quantity MF in milligrams is plotted on an ordinate 62. Here, the injection time denotes the time duration for which the injection valve is open. The curve 63 illustrates the quantity characteristic curve for a magnetic valve which exhibits bouncing, and the curve 65 illustrates the case of an injection valve which exhibits no bouncing or only a very low level of bouncing.

For the injection valve which exhibits only a very low level of bouncing (curve 65), there is an almost linear relationship between the injection time and the injection quantity, at any rate for injection times which are greater than a threshold value (approximately 0.3 ms) which is denoted by reference designation 67. For the magnetic valve which exhibits bouncing (curve 63), in a region 69 of short injection times, there is an intense deviation from a linear characteristic, that is to say from a linear relationship between the injection time and the injection quantity. In the case of conventional methods, an injection time in the region 69 is avoided for such magnetic valves. Thus, in the prior art, it would not be possible to perform or implement relatively short injection times, in particular in a range between approximately 0.3 ms and 0.4 ms, because a monotonous gradient is not realized.

Embodiments of the present invention determine the magnetic flux at an early stage during an opening movement or during an opening process of the magnetic valve, and perform a control intervention at an early point in time by virtue of the voltage applied to the coil being set such that bouncing that is expected to occur is reduced.

Figure 5:
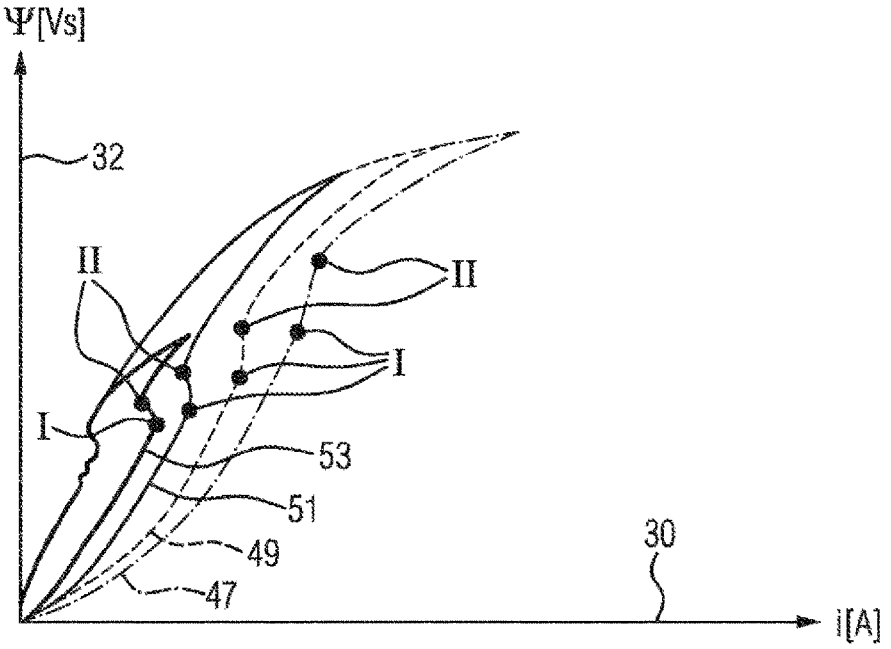
FIG. 5 illustrates graphs of state trajectories obtained by means of different actuation voltage profiles.

The form of the ψ-I curve in the case of different actuation voltages (3 V . . . 18 V) is illustrated in FIG. 5 by trajectories 47 (excitation voltage 18 V), 49 (excitation voltage 6 V), 51 (excitation voltage 12 V) and 53 (excitation voltage 3 V). As may be seen from FIG. 5, with increasing voltages, it becomes increasingly more difficult to reliably detect the states I and II, because only small changes in gradient occur. For example, in the case of an excitation voltage of 18 V, it may be difficult to reliably detect the state I. Therefore, a measurement of reference curves or a measurement for determining a stroke in the case of relatively small excitation voltages, for example between 3 V and 12 V, may be performed. The curves 47, 49, 51 and 53 illustrated in FIG. 5 may represent measurement data or reference data.

Figure 6:
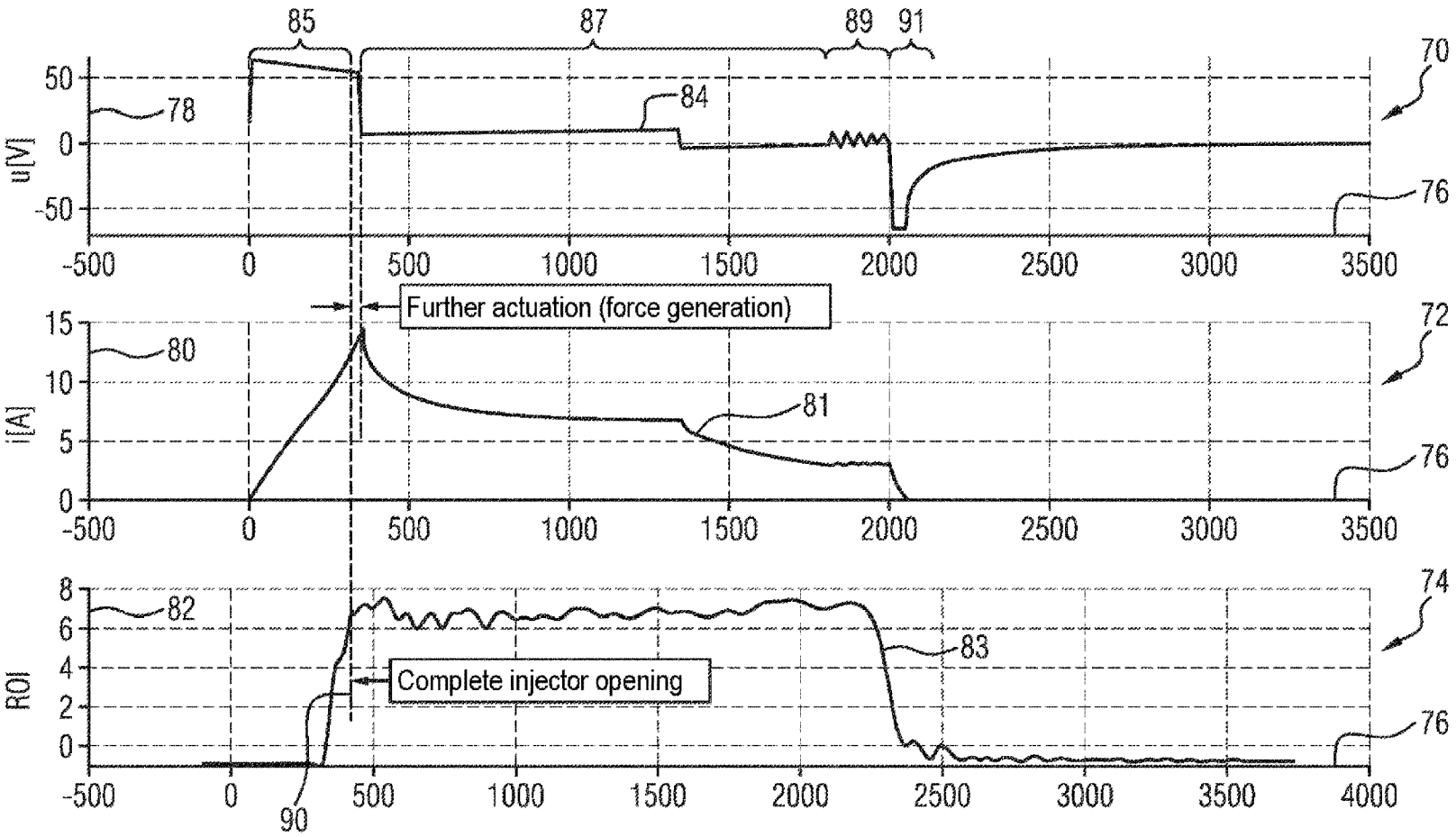
FIG. 6 illustrates graphs for illustrating magnetic valve actuation or injector actuation.

FIG. 6 illustrates three graphs 70, 72 and 74 which illustrate an actuation of a magnetic valve according to embodiments of the present invention.

Here, the time in microseconds is plotted in each case on the abscissae 76. The level of the voltage applied to the coil 3 is plotted on the ordinate 78 of the graph 70, the level of the current through the coil 3 is plotted on the ordinate 80 of the graph 72, and the injection rate (that is to say injection quantity per unit time) of the fuel in the case of the magnetic valve being actuated in accordance with the voltage profile of the graph 70 is plotted on the ordinate 82 of the graph 74.

The voltage profile 84 in the graph 70 of FIG. 6 includes a boost phase 85, a holding phase 87 and a depletion phase 91. During the boost phase 85, a boost voltage of approximately 50 V or even up to 65 V is applied to the coil 3 for the purposes of opening the valve 1. The boost voltage is maintained for a time duration of between 300 ρs and 600 μs. In particular, the boost voltage is maintained until a defined current value or a maximum time duration is reached. In the boost phase 85, the armature or needle movement occurs, and therefore the stroke signal in the ψ-I curve is weak. This may be the case in particular if a conventional armature is used which generates very high eddy currents in the case of relatively high boost voltages.

In the conventional method, the needle bouncing may be identified only indistinctly, and an adaptation of the electrical actuation to the needle movement in order to reduce the bouncing may be difficult in this case.

The graph 72 shows, by means of a curve 81, the current profile that arises in the coil owing to the voltage profile 84. At the start of the boost phase 85, the current 81 rises intensely, and reaches a maximum at the end of the boost phase. During the holding phase 87, the current decreases, but the valve is held open in this phase and is regulated substantially to a value of zero after the completion of the depletion phase 91. Beyond the phase 91, the magnetic valve is closed.

The curve 83 of the graph 74 shows the injection rate as a function of the time. After the completion of the boost phase 85, the injection rate has risen to a certain value, which is maintained, aside from small fluctuations, during the holding phase 87. The time point denoted by the reference designation 90 represents a time point of complete injector opening.

The injection rate profile 83 may in this case exhibit a high degree of correspondence or correlation with the needle movement. Despite the complete opening of the injector (armature makes contact with pole piece), the actuation voltage is maintained, and thus the accelerating magnetic force continues to be increased, which conventionally leads to increased bouncing. The bouncing processes may differ between the individual injectors, because the injectors open at different times, and thus the force profiles after the complete opening may differ. Furthermore, the damping characteristics of the injectors may differ owing to the respective geometry of the damping gap.

Embodiments of the present invention permit a control intervention through modification of the voltage profiles, for example of the voltage profile 84 which is illustrated in the graph 70 of FIG. 6. By means of a recorded ψ-I curve, it is the case in one embodiment of the present invention that the injector movement is identified (in particular also online during operation of a vehicle), and the actuation is modified such that the bouncing behavior is reduced. For this purpose, it is for example possible for the needle movement (state I and/or state II) to be determined in the ψ-I curve, and for the associated actuation to be optimized with regard to bouncing, for example through modification of the peak current level (of the current 81) or through interruption of the actuation voltage (voltage 84, for example during the boost phase 85, during the holding phase 87 or a combination of both).

For example, the entire needle movement between the first state I and the second state II may be identified (see for example FIGS. 2 and 3), and the actuation may be adapted such that the gradients dψ/di during the movement are identical for different injectors (adaptation to setpoint value or reference curve). If the first state I is incorporated into the identification, then the needle movement may, even after the start of the movement, be moved onto a bouncing-minimized path through suitable actuation, that is to say a regulating intervention may be performed already before the bouncing process. Such a regulating intervention before the bouncing may in this case comprise, for example, an identification of the first state I and an execution of predefined actuation/pilot control before or during the first state I (for example, the current value in the first state I may be adapted or set with the addition of a defined current difference of with the addition of a lengthening of the boost phase).

Alternatively or in combination therewith, it is also possible for a regulating intervention to be performed after the abutment of the armature against the pole piece, for example by virtue of the second state II being identified and predefined actuation/pilot control being executed in the second state II (for example, the current value in the second state with the addition of a defined current difference or with the addition of an elongation of the boost phase or interruption of the boost phase with subsequent continuation).

Figure 7A:
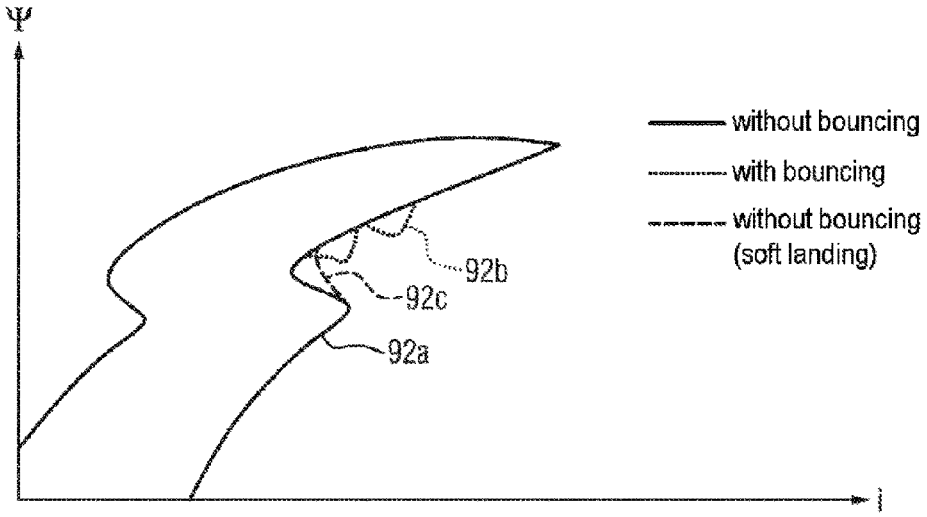
FIG. 7A is a graph illustrating bouncing behavior of an armature of a magnetic valve controlled according to embodiments of the present invention.

FIGS. 7A, B, C and D show graphs which illustrate the armature behavior for different situations if actuation is performed in accordance with embodiments of the invention: without bouncing (solid line, curves denoted by 'a'), with bouncing (dotted line, curves denoted by 'b') and with soft landing (dashed line, curves denoted by 'c').

The bouncing is identified in the PSI-I curve 92*a*, 92*b* or 92*c* respectively in FIG. 7A. To minimize the bouncing, the duration of the boost phase 85 of the actuation profiles 84*a*, 84*b*, 84*c* is lengthened for the subsequent actuations, and thus the force on the armature is increased during the abutment (see FIG. 7D).

Another solution is a so-called 'soft landing'. Here, the armature is decelerated already before it reaches the pole piece as a result of shortening of the duration of the boost phase, and the abutment thus occurs with reduced momentum, which in turn reduces or prevents the bouncing.

Figure 7B:
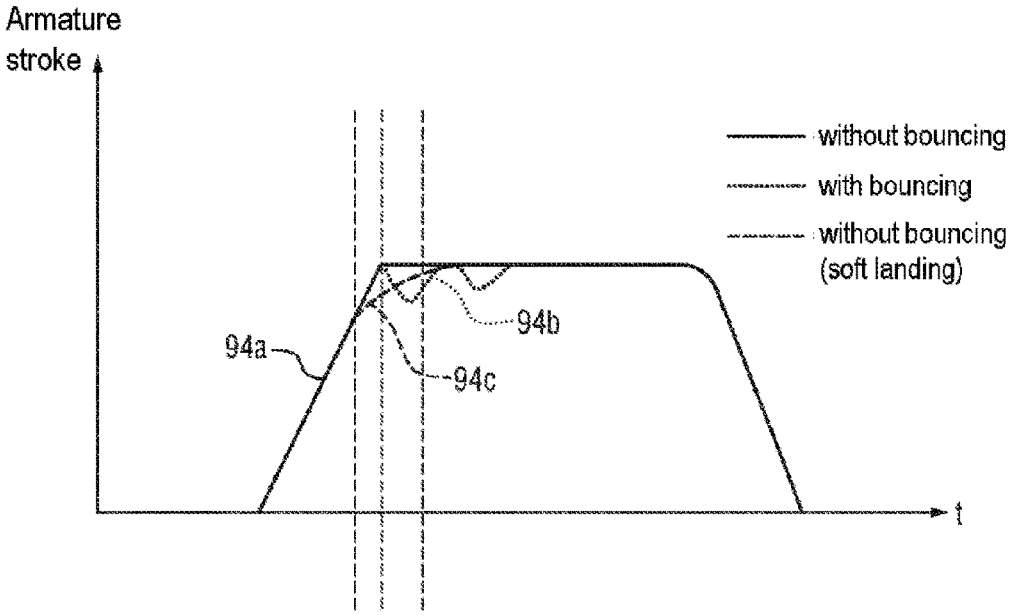
FIG. 7B is a graph illustrating the stroke of the armature versus time, where the armature is controlled according to embodiments of the present invention.

In FIG. 7B, the armature stroke is illustrated versus the time for the various cases as curves 94*a*, 94*b*, 94*c*.

Figure 7C:
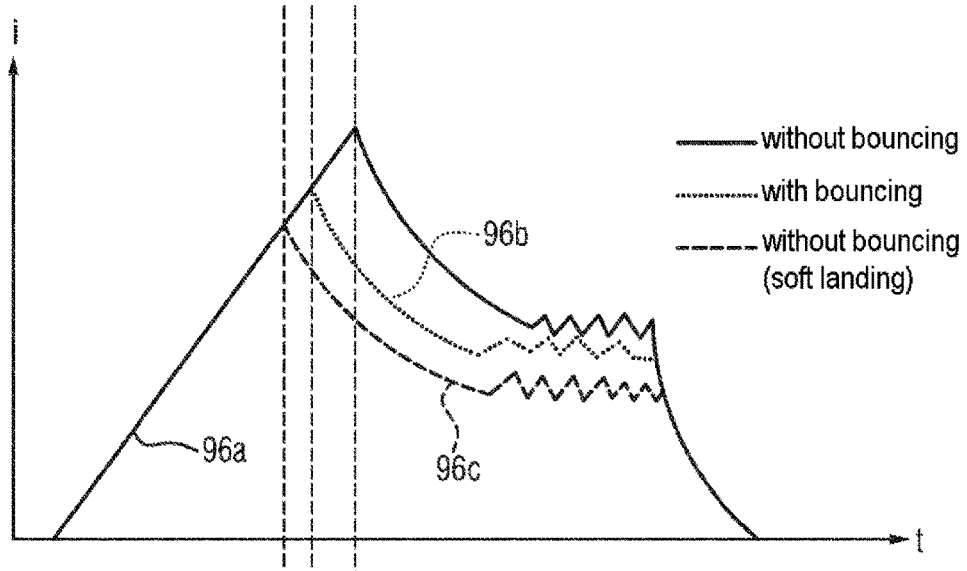
FIG. 7C is a second graph illustrating the stroke of the armature versus time, where the armature is controlled according to embodiments of the present invention.
Figure 7D:
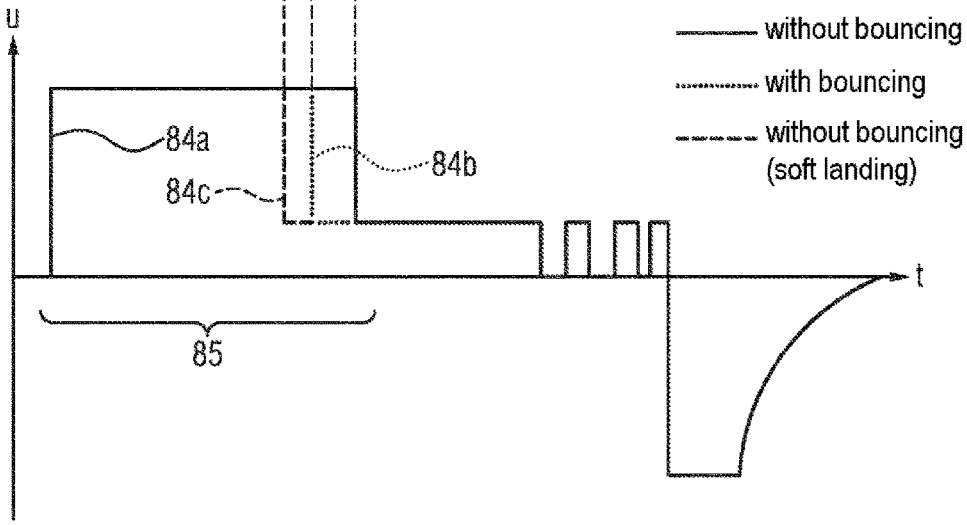
FIG. 7D is a graph illustrating the actuation profiles of an armature, where the armature is controlled according to embodiments of the present invention.

In FIG. 7C, the current is illustrated versus the time for the various cases as curves 96*a*, 96*b*, 96*c*.

In a particular embodiment of the invention, it is proposed that an injector be used in which no or reduced eddy currents occur. In such a case, it may be possible for the ψ-I curves to be implemented even in the case of standard actuation (for example with 65 V boost voltage).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for controlling a magnetic valve, comprising:

providing a coil for producing a magnetic force;

providing an armature which is displaceable by the magnetic force generated by the coil;

providing a closure element which is displaceable by the armature;

providing a combustion chamber, the closure element being displaceable for the purposes of injecting fuel into the combustion chamber;

energizing the coil with a voltage in accordance with a first voltage profile in order to generate a first electrical current through the coil;

determining a first profile as a function of a first magnetic flux and the first electrical current;

identifying, in the first profile, a first characteristic of at least one first start of displacement at which the armature begins to displace the closure element during an opening of the magnetic valve;

generating a second voltage profile and energizing the coil in accordance with the second voltage profile, such that, in a second profile, as a function of a second magnetic flux and a second electrical current, a second characteristic of a second start of displacement during the opening or during a second opening of the magnetic valve is more similar to a reference characteristic than the first characteristic;

wherein energizing the coil, determining the first profile, identifying the first characteristic in the first profile and generating the second voltage profile, are performed open loop;

providing a first curve of a coordinate system;

providing a second curve of the coordinate system;

representing the first profile and the second profile by the first curve and the second curve respectively in a coordinate system in which the electrical current is plotted along one axis and the magnetic flux is plotted along another axis; and providing a pole piece in contact with the armature when the magnetic valve is in a fully open position such that at least one of the first characteristic or the second characteristic includes at least one of a gradient or a position on at least one of the first curve or the second curve at least at the respective start of displacement and along at least one section of an opening movement of the closure element between the respective start of displacement and a contact state in which the armature abuts against the pole piece in order to end the opening movement, wherein the reference characteristic includes at least one of a reference gradient or a reference position;

wherein each of the first and second voltage profiles includes a boost voltage for opening the magnetic valve, and energizing the coil in accordance with the second voltage profile begins at a time before or after the contact state, and the second voltage profile has a lengthened, shortened or interrupted duration of a boost phase in relation to the first voltage profile.

2. The method of claim 1, further comprising identifying the respective start of displacement as a point or region at which a gradient of at least one of the first curve or the second curve changes.

3. The method of claim 1, further comprising identifying the respective contact state as a point or region at which a gradient of at least one of the first curve or the second curve changes.

4. The method of claim 1, wherein energizing the coil in accordance with the second voltage profile begins at a time before the contact state when energizing of the coil in accordance with the first voltage profile.

5. The method of claim 1, wherein energizing of the coil in accordance with the second voltage profile begins at a time after the contact state.

6. The method of claim 1, further comprising:

determining the reference characteristic as a function of at least one section of at least one of the first curve or the second curve beyond the contact state;

selecting the second voltage profile such that the at least one section has fewer alternating gradients.

7. The method of claim 6, further comprising:

providing at least one reference data set, including a reference curve of electrical current and magnetic flux when there is a low level of bouncing of the armature on the pole piece;

performing a test on the operation of the magnetic valve using the at least one reference data set for the selecting of the second voltage profile.

8. The method of claim 1, wherein the first characteristic includes at least one of the gradient and the position on the first curve during which the coil is energized in accordance with the first voltage profile between the start of displacement and the contact state in which the armature abuts against the pole piece in order to end the opening movement.

9. The method of claim 1, wherein the first characteristic includes the gradient and the position on the first curve during which the coil is energized in accordance with the first voltage profile between the start of displacement and the contact state in which the armature abuts against the pole piece in order to end the opening movement.

10. An engine control unit for controlling a magnetic valve, the magnetic valve including a coil for producing a magnetic force, an armature which is displaceable by the magnetic force produced by the coil, and a closure element which is displaceable by the armature, the closure element being displaceable for injecting fuel into a combustion chamber, the engine control unit comprising:

a driver for energizing the coil with a voltage in accordance with a first voltage profile in order to generate a first electrical current through the coil to open the magnetic valve; and a determination module which determines a first profile as a function of a first magnetic flux and the first electrical current, and identifies in the first profile a first characteristic of at least one first start of displacement at which the armature begins to displace the closure element;

wherein at least one of the determination module and the driver generates a second voltage profile, open loop, without using or evaluating a signal from the coil, and energizes the coil in accordance with the second voltage profile, such that in a second profile, as a function of a second magnetic flux and a second electrical current, a second characteristic of a second start of displacement is more similar to a reference characteristic than the first characteristic, wherein voltage profile and the second voltage profile includes a boost phase during which the driver provides a boost voltage to the coil for opening the magnetic valve, a hold phase during which the driver provides a voltage less than the boost voltage to the coil so that the magnetic valve remains open, and a depletion phase during which the driver provides a decreasing voltage less than the voltage of the hold phase, wherein the coil is not energized at an end of the depletion phase and the magnetic valve is closed, and wherein the boost phase of the second voltage profile has at least one of a shorter duration than a duration of the boost phase of the first voltage profile, and a boost voltage that is interrupted during the boost phase by one or more voltage levels that is less than the boost voltage.

11. The engine control unit of claim 10, wherein the engine control unit generates a first curve representing the first profile and a second curve representing the second profile in which, for each of the first curve and the second curve, the electrical current of the coil is plotted along one axis and magnetic flux is plotted along another axis.

12. The engine control unit of claim 11, wherein the magnetic valve further comprises a pole piece in contact with the armature when the magnetic valve is in a fully open position, and wherein the first characteristic includes at least one of a gradient and a position on the first curve between and including a start of displacement and a contact state in which the armature abuts against the pole piece in order to end an opening movement of the closure element, wherein the reference characteristic includes at least one of a reference gradient and a reference position.

13. The engine control unit of claim 12, wherein the second characteristic includes at least one of a gradient and a position on the second curve between and including the start of displacement and the contact state.

14. The engine control unit of claim 13, wherein the engine control unit is configured to identify the contact state as a point or region at which a gradient of at least one of the first curve and the second curve changes.

15. The engine control unit of claim 13, wherein the driver energizes the coil according to the second voltage profile beginning at a time before the contact state in which the magnetic valve was initially energized by the driver according to the first voltage profile.

16. An engine control unit for controlling a magnetic valve, the magnetic valve including a coil for producing a magnetic force, an armature which is displaceable by the magnetic force produced by the coil, and a closure element which is displaceable by the armature, the closure element being displaceable for injecting fuel into a combustion chamber, the engine control unit comprising:

a driver for energizing the coil with a voltage in accordance with a first voltage profile in order to generate a first electrical current through the coil to open the magnetic valve; and a determination module which determines a first profile as a function of a first magnetic flux and the first electrical current, and identifies in the first profile a first characteristic of at least one first start of displacement at which the armature begins to displace the closure element;

wherein at least one of the determination module and the driver generates a second voltage profile, open loop, without using or evaluating a signal from the coil, and energizes the coil in accordance with the second voltage profile, such that in a second profile, as a function of a second magnetic flux and a second electrical current, a second characteristic of a second start of displacement is more similar to a reference characteristic than the first characteristic, wherein the engine control unit generates a first curve representing the first profile and a second curve representing the second profile in which, for each of the first curve and the second curve, the electrical current of the coil is plotted along one axis and magnetic flux is plotted along another axis, wherein the magnetic valve further comprises a pole piece in contact with the armature when the magnetic valve is in a fully open position, and wherein the first characteristic includes at least one of a gradient and a position on the first curve between and including a start of displacement and a contact state in which the armature abuts against the pole piece in order to end an opening movement of the closure element, wherein the reference characteristic includes at least one of a reference gradient and a reference position, wherein the second characteristic includes at least one of a gradient and a position on the second curve between and including the start of displacement and the contact state, and wherein the coil is energized by the driver during a valve actuation cycle in which the coil is initially energized according to the first voltage profile and thereafter the driver modifies the energizing to be according to the second voltage profile, the modification occurring before the contact state.

17. A method for controlling a magnetic valve, comprising:

providing a coil for producing a magnetic force;

providing an armature which is displaceable by the magnetic force generated by the coil;

providing a closure element which is displaceable by the armature;

providing a combustion chamber, the closure element being displaceable for the purposes of injecting fuel into the combustion chamber;

energizing the coil with a voltage in accordance with a first voltage profile in order to generate a first electrical current through the coil;

determining a first profile as a function of a first magnetic flux and the first electrical current;

identifying, in the first profile, a first characteristic of at least one first start of displacement at which the armature begins to displace the closure element during an opening of the magnetic valve;

generating a second voltage profile and energizing the coil in accordance with the second voltage profile, such that, in a second profile, as a function of a second magnetic flux and a second electrical current, a second characteristic of a second start of displacement during the opening or during a second opening of the magnetic valve is more similar to a reference characteristic than the first characteristic;

wherein energizing the coil, determining the first profile, identifying the first characteristic in the first profile and generating the second voltage profile, are performed open loop;

providing a first curve of a coordinate system;

providing a second curve of the coordinate system;

representing the first profile and the second profile by the first curve and the second curve respectively in a coordinate system in which the electrical current is plotted along one axis and the magnetic flux is plotted along another axis; and providing a pole piece in contact with the armature when the magnetic valve is in a fully open position such that the first characteristic includes at least one of a gradient and a position on the first curve during which the coil is energized in accordance with the first voltage profile between the start of displacement and a contact state in which the armature abuts against the pole piece in order to end the opening movement, wherein the second characteristic includes at least one of the gradient and the position on the second curve during which the coil is energized in accordance with the first voltage profile between the start of displacement and the contact state.

18. The method of claim 17, wherein the second characteristic includes the gradient and the position on the second curve during which the coil is energized in accordance with the first voltage profile between the start of displacement and the contact state in which the armature abuts against the pole piece in order to end the opening movement.

* * * * *